US007180448B2

(12) United States Patent
Suganthan et al.

(10) Patent No.: US 7,180,448 B2
(45) Date of Patent: Feb. 20, 2007

(54) PLANAR INVERTED F ANTENNA AND METHOD OF MAKING THE SAME

(75) Inventors: Shanmuganthan Suganthan, Watford (GB); Vladimir Stoiljkovic, Aylesbury (GB)

(73) Assignee: Centurion Wireless Technologies, Inc., Lincoln, NE (US)

( * ) Notice: Subject to any disclaimer, the term of this patent is extended or adjusted under 35 U.S.C. 154(b) by 129 days.

(21) Appl. No.: 10/667,933

(22) Filed: Sep. 22, 2003

(65) Prior Publication Data

US 2005/0062655 A1 Mar. 24, 2005

(51) Int. Cl.
*H01Q 1/24* (2006.01)

(52) U.S. Cl. ..... 343/700 MS; 343/702

(58) Field of Classification Search ..... 343/700 MS, 343/702, 846

See application file for complete search history.

(56) References Cited

U.S. PATENT DOCUMENTS

| | | | | |
|---|---|---|---|---|
| 5,532,707 | A * | 7/1996 | Klinger et al. | 343/793 |
| 5,914,690 | A | 6/1999 | Lehtola et al. | 343/702 |
| 6,344,823 | B1 * | 2/2002 | Deng | 343/700 MS |
| 6,414,641 | B1 * | 7/2002 | Carlson et al. | 343/702 |

OTHER PUBLICATIONS

International Searching Authority "Notification of Transmittal of the International Search Report and the Written Opinion of the International Searching Authority, or the Declaration", Aug. 3, 2005.

* cited by examiner

*Primary Examiner*—Michael C. Wimer
(74) *Attorney, Agent, or Firm*—Holland & Hart LLP

(57) ABSTRACT

A planar inverted F antenna having a radiating patch and a carrier is described. The radiating patch includes a blank, a first connector and a second connector. The first connector is formed from the blank material and provides a cutout region within the periphery of the radiating patch.

21 Claims, 2 Drawing Sheets

PLANAR INVERTED F ANTENNA AND METHOD OF MAKING THE SAME

FIELD OF THE INVENTION

The present invention relates to antennas and, more particularly, to planar inverted F antennas.

BACKGROUND OF THE INVENTION

RF antennas are widely used to provide wireless capability in communication devices such as cellular telephones, wireless personal digital assistants (PDAs), portable computers, electronic games, and the like.

One common antenna is a planar inverted F antenna (the "PIFA"). The PIFA is a small antenna that can conveniently fit in most electronic devices. The PIFA includes a radiating patch, a carrier, and a ground plane. The radiating patch includes a ground connector and a feed connector. In a known PIFA, the ground and feed connectors extend from the periphery of the radiating patch for connection to the ground plane and power feed of a wireless communication device, respectively. Alternatively, an internal connection to the radiating patch has been provided by a separate spring finger attached to either the carrier molding or to a printed circuit board of the wireless communication device.

SUMMARY OF THE INVENTION

A radiating patch of a PIFA having at least one connector formed from the radiating patch material and provides a cutout region within the periphery of the radiating patch. Further, a PIFA including such a radiation patch is provided also. The contact is formed by cutting material from a patch enabling the connector to be provided anywhere on the radiating patch instead of being limited to the periphery of the radiating patch.

The present invention also provides a method of making the radiating patches and the PIFAs. The method includes providing a conductive blank having a periphery and cutting a first connector from a portion of the blank internal to the periphery. The first connector is bent away from the blank to form a cutout region in the blank. A second connector is formed on the conductive blank also.

The foregoing and other features, utilities and advantages of the invention will be apparent from the following more particular description of a preferred embodiment of the invention as illustrated in the accompanying drawings.

BRIEF DESCRIPTION OF THE DRAWING

The above and other objects and advantages of the present invention will be apparent upon consideration of the following detailed description, taken in conjunction with the accompanying drawings, in which like reference characters refer to like parts throughout, and in which.

DETAILED DESCRIPTION

Figure 1:
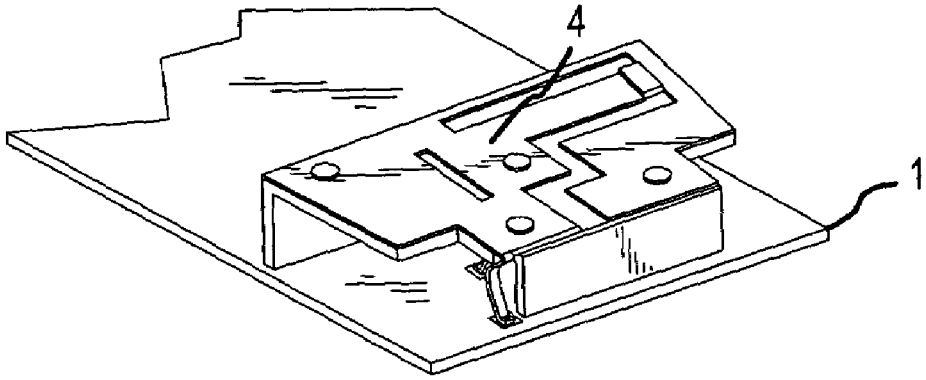
FIG. 1 depicts a perspective view of an antenna illustrative of the present invention assembled onto a printed circuit board.

FIG. 1 shows an assembled Planar Inverted F Antenna (PIFA) 4 illustrative of the present invention, which may be used in a wireless communication device such as a cellular telephone, a wireless personal digital assistant (PDA), a laptop computer, and the like. The PIFA 4 is connected to a printed circuit board (PCB) 1, which may be a component of the wireless communication device.

Figure 2:
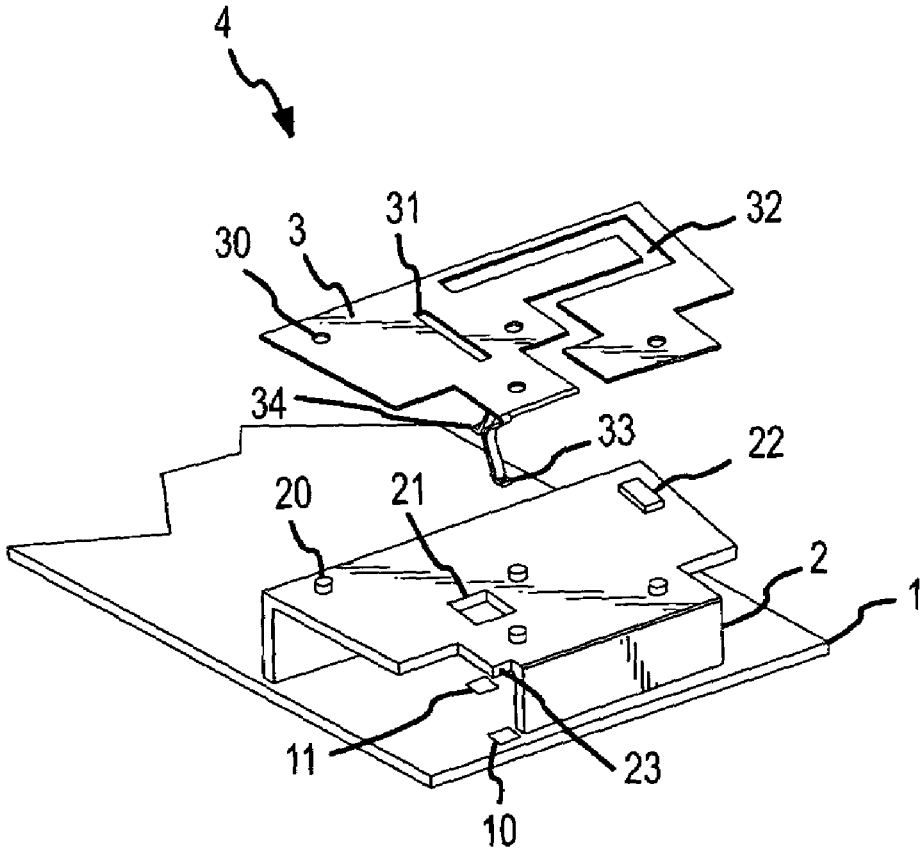
FIG. 2 depicts an exploded view of the antenna of FIG. 1.

FIG. 2 shows an exploded view of the PIFA 4 shown in FIG. 1. The PIFA 4 includes a carrier 2 and a patch 3. The patch 3 is shaped to radiate RF energy at particular frequencies. The patch 3, for example, may include one or more internal, shaped cutout 32. Cutout 32 quasi partitions patch 3 for multiband operation.

The patch further includes a ground connector 33 and a feed connector 34 for electrically connecting the PIFA with a printed circuit board 1 of a wireless communication device. The ground connector 33 and/or the feed connector 34 may be plated with a suitable conductive material, such as nickel or gold, or may be left un-plated where desired. Where a connector is formed from a corrosion-resistant material, such as a copper/nickel/zinc material, or where otherwise desired, the ground connector 33 and/or the feed connector 34 may be left un-plated.

Figure 4:
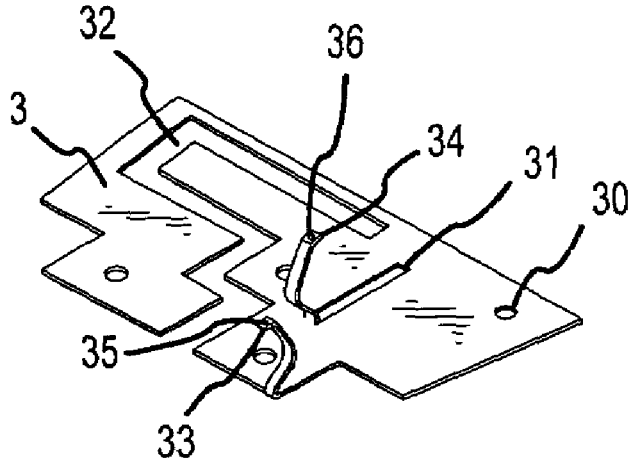
FIG. 4 depicts bottom view of the radiating patch of the antenna FIG. 1.

One or both of the connectors may be formed by cutting through the patch 3. As shown in FIG. 2, for example, the feed connector 33 is formed by cutting through the patch 3 and leaving an internal cutout 31. For the purposes of the present invention, the terms "cut" or "cutting" include any means of forming a connector from within the periphery of the patch 3 whether by stamping, cutting, etching, engraving, scoring, and the like. Alternatively, a connector may be formed by cutting through the patch 3, such that the cutout 31 extends to the periphery of the patch 3. The cutout 31, whether internal or extending to the periphery of the patch 3, influences the radiating of the PIFA 4 in the same manner as the cutout 32. Although the cutout 31 is shown as a straight line, the cutout may alternatively form any other shape desired to improve the RF performance of the PIFA 4. For example, the cutout 31 may alternatively include a circle, an arc, a zig-zag line, a meander line, or any other geometric or irregular shape as desired to alter the RF performance of the PIFA 4. Further, although the feed connector 34 shown in FIGS. 2 and 4 is shown substantially coextensive with the cutout 31, the feed connector 34 (or the ground connector 33) may also be a portion of a larger cutout area.

Figure 3:
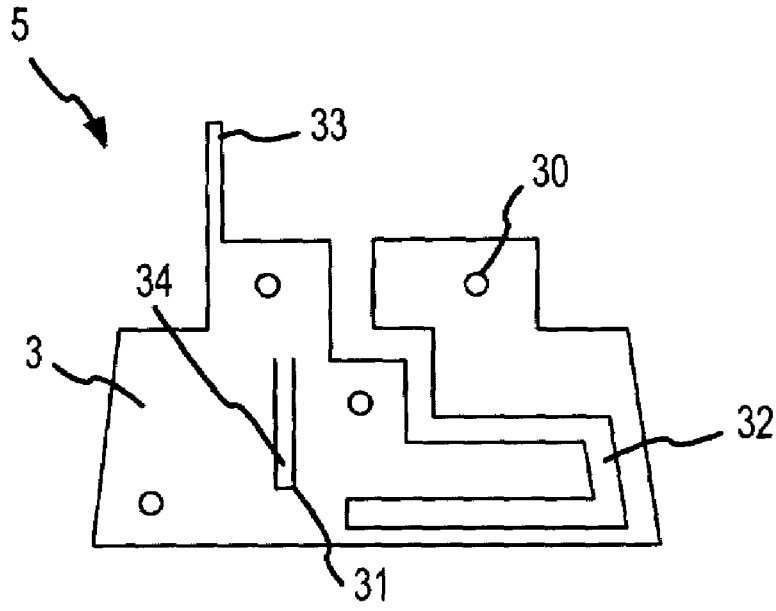
FIG. 3 depicts a blank for forming a radiating patch of the antenna of FIG. 1.

One of the connectors also may be formed by bending a portion extending from the periphery of the patch 3. As shown in FIGS. 2–4, for example, the ground connector 33 is formed by bending a portion of the patch 3 that extends beyond the periphery of the patch 3. In this manner, the connectors may be formed at any position desired on the patch 3 of the PIFA 4.

The carrier 2 may be formed of any suitable non-conducting material such as a dielectric or insulator material (e.g., plastic molding). The carrier 2 supports the patch 3 and maintains the patch 3 in the location relative to the PCB of a wireless communication device. The carrier may be attached to the PCB by any means known in the art, such as by clipping, fixing with screws, and the like.

Pins 20 and/or locating blocks 22 may be used to align patch 3 on carrier 2. The locating pins 20 align with holes 30 (or depressions) in the patch 3. The locating blocks 22 align with cutout 32 and/or cutout 31. The pins 20 and/or blocks 22 may be deformed, such as by heat staking, to hold the patch 3 in place on the carrier 2. Alternatively, the patch 3 can be attached to the carrier by any other means known in the art, such as adhesive, double-sided adhesive tape, clipping, soldering, and the like.

The carrier 2 may further include an opening 21 to allow the feed connector 34 to make contact with a feed contact 11, such as a feed pad or other contactor. Another opening 23 (or notch) further allows the ground connector 33 to make contact with a ground contact 10, such as a ground pad or other ground connector.

FIG. 3 shows a blank 5 that may be used to form the patch 3 shown in FIG. 2. The blank 5 may be formed by a thin metal or electrically conductive plate such as a plate coated with an electrically conductive metal. The blank may alternatively be formed, for example, by a molded or cast plastic sheet coated with an electrically conductive material or formed by mixing an electrically conductive substance in a plastic raw material.

FIG. 4 shows the underside of the patch 3 with the ground connector 33 and the feed connector 34 formed. The shape of the connectors 33 and/or 34 is preferably configured to ensure that adequate pressure is maintained between the connectors 33 and/or 34 and the respective ground contact 10 and feed contact 11 of a wireless communication device. The connectors 33 and/or 34 may also include dimples 35 and 36 to improve the reliability of the connection between the connectors 33 and 34 of the PIFA and the contacts 10 and 11 of a wireless communication device. The shape of the connectors 33 and 34 may also be configured to aid in the location and fixing of the patch 3 to the carrier 2. While not necessary, connectors 33 and 34 should be formed from a material having some elasticity to facilitate the connectors.

While the invention has been particularly shown and described with reference to one or more embodiments herein, it will be understood by those skilled in the art that various other changes in the form and details may be made without departing from the spirit and scope of the invention.

We claim:

1. A radiating patch for use in a planar inverted F antenna, the radiating patch comprising:

an electrically conductive blank comprising a periphery and forming a planar surface a first connector cut from the conductive blank and extending away from the blank in the first direction and forming a cutout region in and co-planar with the conductive blank;

the cutout region being completely internal to the conductive blank; and a second connector extending away from the blank in the first direction, wherein a feed is connected to the first connector such that power is provided at a point internal to the conductive blank.

2. The radiating patch of claim 1, wherein the first connector comprises a feed connector.

3. The radiating patch of claim 1, wherein the second connector comprises a ground connector.

4. The radiating patch of claim 1, wherein the conductive blank comprises a corrosion-resistant material.

5. The radiating patch of claim 1, wherein the cutout comprises a radiating element.

6. The radiating patch of claim 1, wherein the cutout comprises at least one of a straight line, a circle, a polygon, an arc, a zig-zag line and a meander line.

7. The radiating patch of claim 1, wherein the second connector is cut from the conductive blank forming another cutout region.

8. A planar inverted F antenna for use in a wireless communication device having a printed circuit board, the antenna comprising:

a radiating patch comprising a periphery and forming a planar surface;

a first connector for providing a first electrical connection to the printed circuit board of the wireless communication device, the first connector being cut from an internal portion of the radiating patch and extending away from the radiating patch in a first direction; and forming a cutout region internal to and co-planar with the radiating patch;

a second connector for providing a second electrical connection to the printed circuit board of the wireless communication device; and a non-conductive carrier for receiving the radiating patch, wherein a feed is connected to the first connector such that power is provided at a point internal to the conductive blank.

9. The antenna of claim 8, wherein the carrier further comprises an opening to receive the first connector.

10. The antenna of claim 8, wherein the carrier further comprises at least one locating pin for aligning the radiating patch on the carrier.

11. The antenna of claim 10, wherein the locating pin is deformed to secure the radiating patch to the carrier.

12. The antenna of claim 8, wherein the carrier further comprises at least one locating block for aligning the radiating patch on the carrier.

13. The antenna of claim 12, wherein the at least one locating block is deformed to secure the radiating patch to the carrier.

14. The antenna of claim 10, wherein the carrier further comprises at least one locating block for aligning the radiating patch to the carrier.

15. The antenna of claim 8, wherein the cutout comprises a radiating element.

16. The antenna of claim 8, wherein the cutout comprises at least one of a straight line, a circle, a polygon, an arc, a diagonal line and a meander line.

17. The antenna of claim 8, wherein the first connector aligns the radiating patch with the carrier.

18. The antenna of claim 8, wherein the first connector secures the radiating patch to the carrier.

19. The antenna of claim 8, wherein the second connector is formed from another cutout.

20. A planar inverted F antenna for use in a wireless communication device having a printed circuit board, the antenna comprising:

a radiating patch comprising a periphery and forming a planar surface;

means internal to the radiating patch for connecting the radiating patch to the printed circuit board of the wireless communication device, the means for connecting forming a cutout region in and co-planar with the radiating patch, wherein a feed is connected to means internal to the radiating patch for connecting such that power is provided to a point internal to the conductive blank;

a second connector for providing a second electrical connection to the printed circuit board of the wireless communication device; and a non-conductive carrier for receiving the radiating patch.

21. A method of making a radiating patch for use in a planar inverted F antenna, the method comprising:

providing a conductive blank having a periphery and forming a planar surface;

cutting a first connector from a portion of the conductive blank internal to the periphery of the conductive blank and co-planar with the conductive blank; and bending the first connector away from the conductive blank to form a cutout region internal to said conductive blank;

forming a second connector; and arranging the conductive blank over a feed such that the feed contacts the first connector to provide power at a point internal to the conductive blank.

* * * * *